United States Patent [19]

Lagace

[11] Patent Number: 4,972,607

[45] Date of Patent: Nov. 27, 1990

[54] CENTRAL BLOW-DRYER SYSTEM

[76] Inventor: Robert R. Lagace, 2120 Boyer Dr., Carmichael, Calif. 95608

[21] Appl. No.: 472,173

[22] Filed: Jan. 30, 1990

[51] Int. Cl.[5] ..... F26B 19/00

[52] U.S. Cl. ..... 34/90; 34/97; 34/99; 34/91

[58] Field of Search ..... 34/90, 91, 96, 97

[56] References Cited

U.S. PATENT DOCUMENTS

| | | | |
|---|---|---|---|
| 1,070,716 | 8/1913 | Myers | 34/90 |
| 2,043,721 | 6/1936 | Warwick | 34/90 |
| 2,157,047 | 5/1939 | Zwickl | 34/91 |
| 3,171,428 | 3/1965 | Bozeman | 34/90 |
| 3,449,838 | 6/1969 | Chancellor, Jr. | 34/90 |
| 4,873,773 | 10/1989 | Canonge | 34/90 |

*Primary Examiner*—Henry A. Bennet
*Assistant Examiner*—Denise L. F. Gromada
*Attorney, Agent, or Firm*—Mark C. Jacobs

[57] ABSTRACT

A hair-drying system for use primarily in homes and other locations which employs a central forced air blower to disperse air through an air ducting system to air terminals disposed primarily in bathrooms. The air terminals are covered over when in the non-operative position. Upon physical and electrical coupling of a hair-drying unit to the air terminal, which hair-drying unit is comprised of a dryer and a flex tubing, air will be delivered through the flex tubing to the dryer, since the flex tubing is in fluid connection with both the air ducting system and the dryer. An optional damper(s) can be employed to limit air flow. Heat is applied to the air by a dryer mounted switch controlled resistance heater. The electrical energy to operate the dryer is obtained from a grounded electrical outlet mounted adjacent the cover plate of the air terminal. If 110 volt AC is used to power the dryer, the electrical connection would be via a ground fault interrupter to prevent injury. The hair-drying unit can be uncoupled upon completion of use and the air terminal closed over. The system can also be utilized by beauty salons, hotels and animal grooming facilities.

21 Claims, 4 Drawing Sheets

CENTRAL BLOW-DRYER SYSTEM

FIELD OF INVENTION

The invention pertains to hair-drying systems utilizing a blower-dryer.

BACKGROUND OF THE INVENTION

A neat stylish appearance of the hair is a sign of good grooming and is of major significance to a large part of the populace. Females aged 13–20 pay particular attention to their hair as do you young adults of both genders of ages 20–35. These people, and others buy a rather large number of hair dryers annually.

Today's hair dryers tend to be extremely noisy and as such it is often impossible to hear the phone when utilizing one of them. In addition, there is the potential safety hazard of using an electrical appliance near the sink or toilet where water is present.

It is an object therefore of this invention to provide a hair-drying system that employs a central air source.

It is another object to provide a hair-drying system that is quiet due to the absence of a motor to create the forced air in the hand piece for blowing upon the hair to dry it.

A further object is to provide a hair drying system that is substantially free of potential electrical shock due to the optional connection to a Ground Fault Interrupter.

Other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention, reference should be made to the following detailed description taken in connection with the accompanying drawings.

SUMMARY OF THE INVENTION

A hair-drying system for use primarily in homes and business establishments which employs a central forced air blower to disperse air through an air ducting system to air terminals disposed primarily in bathrooms. The air terminals are covered over when in the non-operative position. Upon coupling of a hair-drying unit to an accessed air terminal, air will be delivered through flex tubing to a blow dryer.

An optional damper(s) can be employed to limit air flow.

Heat is applied to the air by a dryer mounted switch controlled resistance heater.

DESCRIPTION OF THE PREFERRED EMBODIMENT

Figure 1:
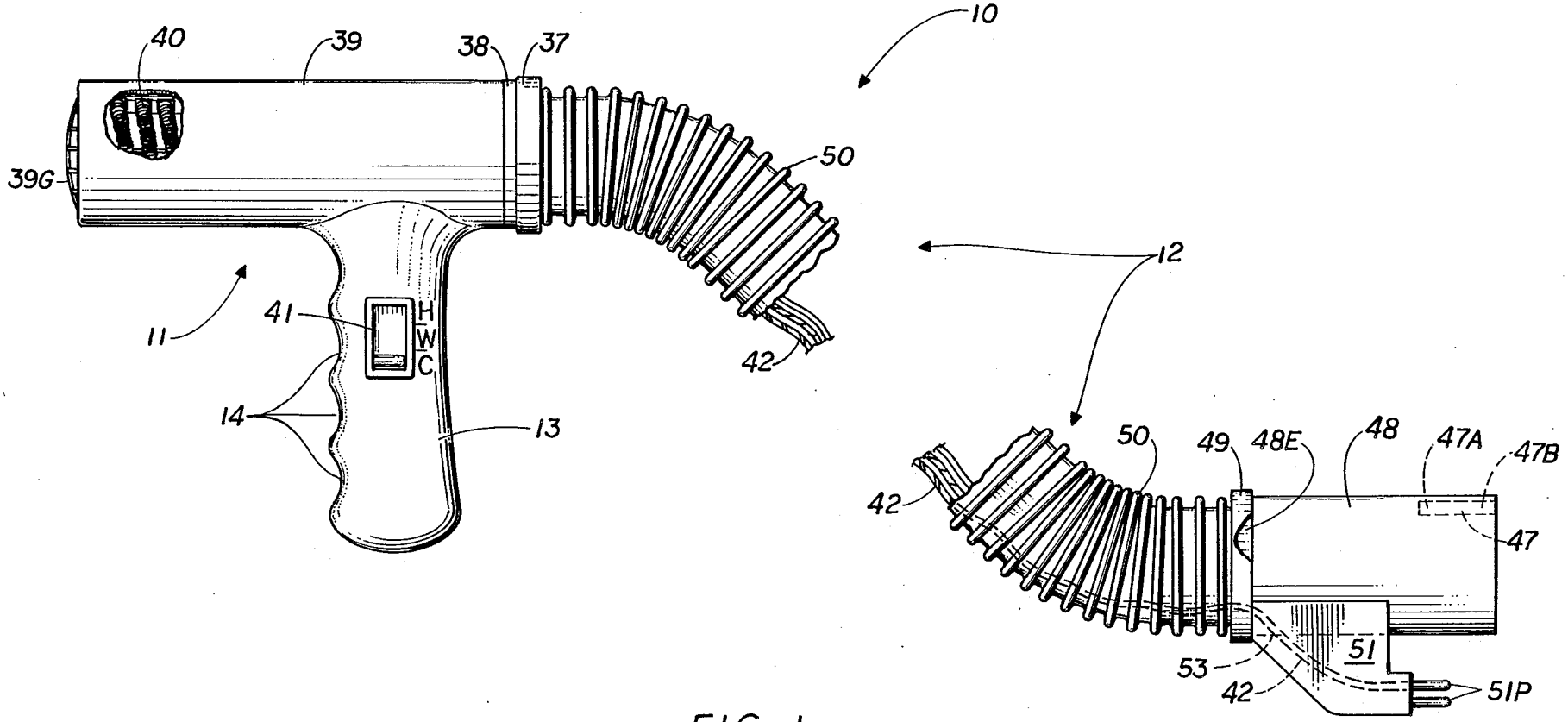
FIG. 1 is a left side elevational view of a hair-drying unit of this invention.

The reader's attention is first turned to FIG. 1, wherein the hair-dryer unit 10 of this invention is seen. It comprises two main portions, a dryer assembly 11, and a flex tubing assembly member 12, and a collar 48. Dryer 11 includes an elongated handle portion 13 having a series of frontal indentations 14 forming a finger grip area. Suitably mounted on handle portion 13 is a 3-position switch 41, the wiring of which is internal to the hollowed out handle portion 13. Switch 41 is conventionally connected to wiring 42 disposed within flex hose 50 as well as to resistance heater 40 visible through the cut away area in the blow-dryer body assembly 39. Body assembly 39 also includes a conventional grill 39G which may be snap fit or otherwise attached across the opening to the hollow cylindrical assembly. Such construction is deemed conventional in the blow dryer art. Disposed at the rear of the dryer 11 is a coupling 38, adapted to receive flex hose 50.

As is seen in FIG. 1 flex tubing member 12 is shown discontinuous, in order to convey the impression of length. It comprises flex tubing 50, terminal coupling 37 and second coupling 49. Stranded wire 42 such as number 14 gauge wire is suitably disposed and optionally adhered within the confines of flex hose 50. Flex hose 50 is joined to the dryer 11 coupling 38 by a terminal coupling of slightly larger cross section 37. Coupling 37 may be friction fit or threadedly engaged to coupling 38 which is the rear end of the blow-dryer assembly 39. It is seen that since blow-dryer assembly 39 is hollow, that air passing through flex hose 50 will communicate with the resistance heater 40 shown disposed within body assembly 39. At the end distal from the blow dryer, flex tubing member 12 terminates in a second coupling 49, which again may be of a friction or threaded nature to correspond with the mode of connection to coupling 48E which is the end section of collar 48.

A male 3-prong conventionally configured AC male adapter 51 is mounted on the underside or 6:00 position on the periphery of the third main portion, namely collar 48 such as to be in a suitable location for engagement with mount bracket 70 to be discussed below. A suitable commercial solvent should be utilized to fixedly secure end 48E to coupling 49 of the flex tubing member 12 in order to assure proper alignment of the male adapter 51 at all times unless end 48E is threadedly engageable with coupling 49. Wires 42, which are disposed within the flex tubing member 12 enter male adapter 51 through a suitable bore 53 (not seen) to permit entry into the interior of male adapter 51 for insertion into the 3-prongs 51P. For ease of understanding, only one of the three wires 42 is shown in broken line disposed within the flex tubing member 12 and entering into the collar 49 to electrically connect to the prongs 51P. Collar 48 as has been noted is a cylindrical member that is open at its distal end. Mounted on the exterior periphery at the distal edge and disposed rearwardly along the length of the collar is a metal contact strip 47 which metal strip is attached to collar 48 and is about ¼" wide by ¾" long.

Figure 2:
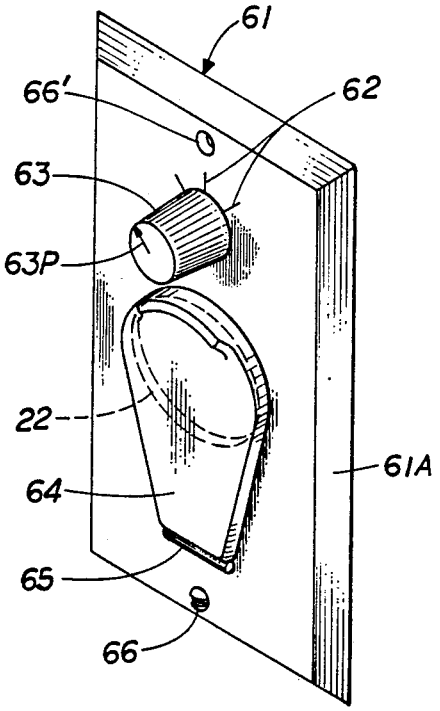
FIG. 2 is a front perspective view of the cover plate for an air terminal.

Reference is now made to FIG. 2. Here the outlet cover plate 61, which resembles a typical electrical outlet cover plate also includes inwardly extending lip 61A along the top, bottom and side edges thereof. A pair of vertically spaced bores 66' are disposed at suitable locations along the central vertical axis. Each of these bores 66' will communicate with one of the pairs of screw holes 67 of mount bracket shown in FIG. 3. The lower of such bores 66' shows a threaded screw 66 disposed therein. Cover plate 61 includes optionally printed indicia 62 to note the location of a damper disposed behind said cover plate the details of which will be set forth below. A damper knob 63 is frictionally engaged upon a damper shaft 27 seen in FIG. 3 as well as in FIG. 6. Damper knob 63 may contain a pointer 63P for alignment with the printed indicia 62 to denote the position of the damper.

A hatch cover 64 is hingedly mounted by hinge 65 for preferably 90° movement to an open position (contrast FIG. 2 with FIG. 5) and overlies opening 22. Movement of hatch cover 64 may be either downwardly or upwardly depending upon the mode of mount of the bracket 70 shown in FIG. 3 to be discussed in detail below. The clamshell shaped hatch cover 64, is specifically configured in such a manner, in order to permit access to the female receptacle 33 located in opening 74 of outlet 68. The disposition of such receptacle 33 be it on the bottom as seen in FIG. 3 or on the top, will dictate the orientation of the cover plate 61 such that it will be seen which direction the hatch cover 64 will pivot, i.e. downwardly or upwardly, but in both cases outwardly.

Figure 3:
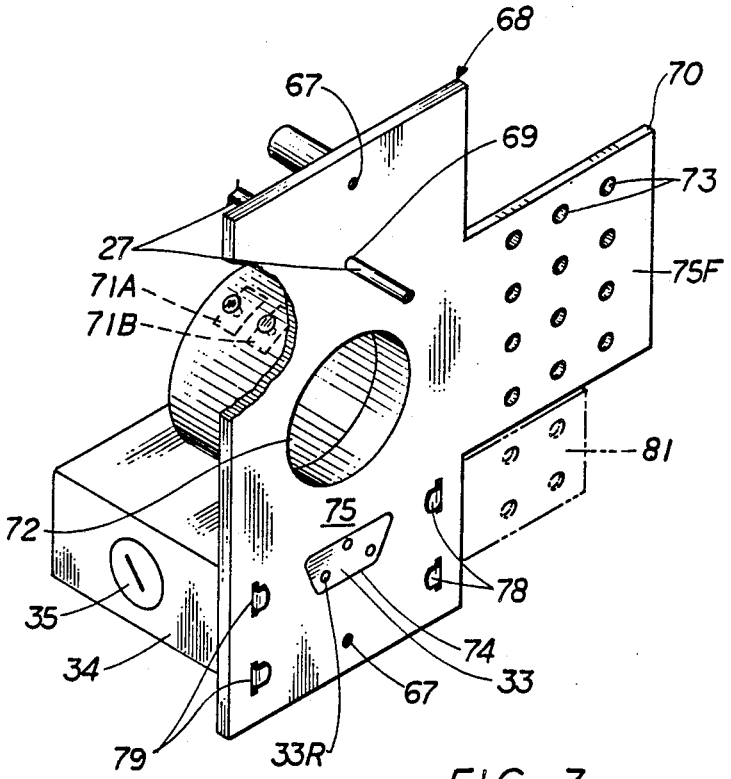
FIG. 3 is a front perspective view of a mounting bracket forming part of this invention.
Figure 6:
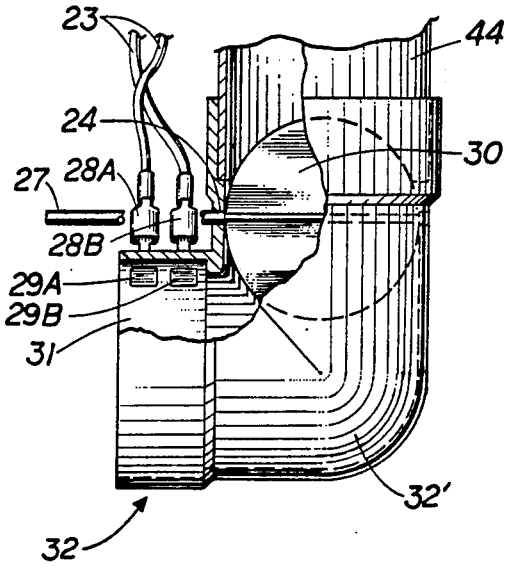
FIG. 6 is a right side elevational view of an air terminal according to this invention.

The discussion now turns to the mount means 68 seen best in FIG. 3, and designated the rough-in outlet 68. It is configured as a tilted T-shape member wherein designator 75 is the main section and designator 70 is the mount flange. Rough-in outlet 68 is about 5" high by 2½" wide for the main section. A pair of vertically spaced threaded bores 67 are provided which are in alignment with apertures 66, of the cover plate 61. Outlet 68 also includes a bore 69 through which passes the damper shaft 27 (seen in FIG. 4). Spaced slots 79 are to receive tabs 78. A female 3-prong receptacle 33 is disposed flush with the front surface of rough-in outlet 68 in opening 74 (see FIG. 3) and extends rearwardly as is seen in FIG. 6 forming part of junction box 34. The female receptacles 33R of outlet 33 are spaced and aligned to matingly receive the male prongs 51P of the male adaptor 51 seen in FIG. 1. The mounting grachet 70 includes a series of holes 73 for mounting said flange to a stud or other surface with screws or nails (not seen).

As seen in FIG. 6 a low voltage electrical connector comprised of two metal contacts designated 29A & B, one of each of which is in contact with each of the spaced spade connectors 28 and is electrically connected thereto as by soldering. Each spade connector 28 is in turn wired to a low voltage wire 23, which in turn is electrically connected to a normally open solenoid wired to the blower.

When the air terminal 32 is connected to the rough-in outlet the electrical strips 71, (see FIG. 3) comprised of two spaced copper or other metal electrical contacts 71A and 71B makes contact with one of said metal contacts 29 respectively. The engagement of the collar 48 into the rough-in outlet brings the single electrical contact strip 47 which has two sections 47A, 47B (FIG. 1) into electrical contact with contacts 71A and 71B to thereby close the circuit and cause the normally open solenoid (not seen) to close and thus actuate the blower.

Figure 4:
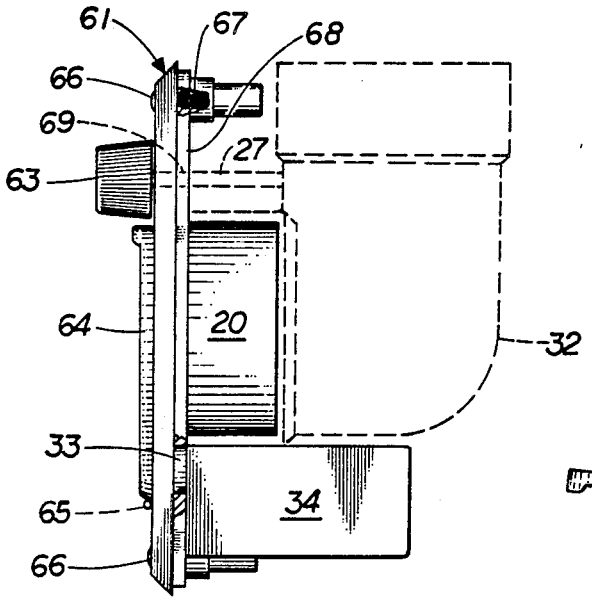
FIG. 4 is a right side elevational view showing the cover plate secured to the mounting bracket.

As seen in FIG. 4 a collar 20 is disposed on the rear side of main section 75 surrounding opening 72 such as to be in fluid communication.

Reference is now made to FIG. 4. Here the rough-in outlet 68 is seen assembled to the cover plate 61 and the air terminal 32 is shown in dashed line. Outlet screws 66 are seen to be in threaded engagement with threaded bores 67 such that the outlet cover plate 61 is nested with rough-in outlet 68. Damper shaft 27, of which more will be discussed below is seen passing through damper shaft bore 69 in outlet 68 to be in frictional or other engagement with knob 63. Collar 20, is preferably tapered for ease of frictional engagement with the opening 31 of air terminal 32 (see FIG. 6). Note the disposition of junction box 34 beneath air terminal 32. For ease of understanding the access screw 35 has been omitted in this figure. Also omitted here but visible in FIG. 3 are a series of mounting tabs 78 for securing the junction box to rough-in outlet 68 via slots 79. The relative disposition of these mounting tabs 78 is seen in FIG. 3. Optionally a side extending mounting flange 81 (shown in phantom line) can extend from the junction box to mount the junction box to a stud. If desired junction box 34 can be secured to air terminal 32 as by a strap or other conventional means, e.g., tabs and slots. Female adaptor 33 is shown mounted on the front of the junction box and may be connected via tabs, and slots for example.

Figure 10:
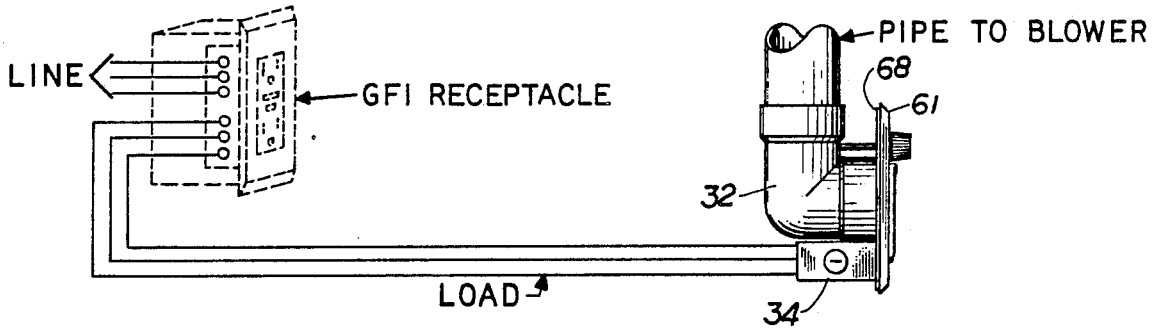
FIG. 10 is an electrical schematic pertaining to a variant of this invention.

Junction box 34 may contain standard ground fault interrupt (GFI) circuitry 59 and need not be further discussed in detail. However reference is made to FIG. 8 which shows the power line 80 electrically connected to three screw terminals 37 disposed on the rear surface of junction box 34. The wiring mode shown is exemplary only and shows a typical electrical hookup mode for the GFI circuitry. Where the junction box may contain circuitry of a GFI, alternatively one can electrically tap off the existing GFI circuit already in bathrooms per the uniform building code. If the outlet in the bathroom is not on a GFI circuit then a GFI outlet would have to be obtained and installed and then power would be run from the load terminals on the GFI outlet to the junction box. See FIG. 10.

Air terminal 32 as seen in FIG. 6 comprises a conventional Schedule 20 PVC or heavier elbow 32, having about a 1.5 inch diameter opening 31. A damper or flapper 30 of a circular nature is disposed within elbow 32'. Damper 30 has a control shaft 27 to orient the damper thereby limiting air flow in the elbow. Shaft 27 passes through hole 24 in said elbow 32'. Damper shaft 27 may be frictionally engaged or threadedly engaged to the damper via a suitable connecting member not shown, but attached to the damper.

A pair of low voltage wires 23, terminate in spade connectors 28A & 28B, which matingly electrically electrical conduits not seen, which conduits are connected to the low voltage connectors 29A, 29B disposed in an offset relationship. Metal strip 47 disposed on collar 48 includes spaced contacts 47A and 47B adapted to engage contacts and feed through 71A & 71B on collar 20 of rough in outlet 68 which in turn contact 29A & 29B.

Figure 5:
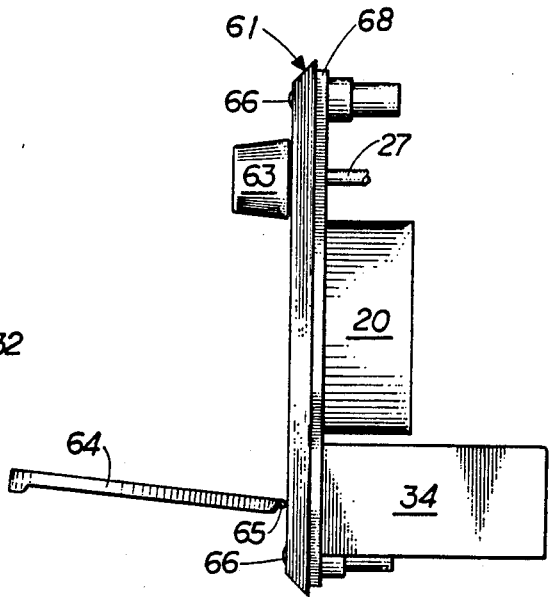
FIG. 5 is a view similar to FIG. 4 but wherein the hatch cover of the cover plate is in an open rather than closed position.

FIG. 5 is related to FIG. 4 but only depicts the cover plate 61. Here the outlet hatch cover 64 is seen in its lowered or open position thereby exposing opening 72, which is preferably of about 1.5 inch in diameter. Only a segment of damper shaft 27 is shown for ease of understanding.

Figure 7:
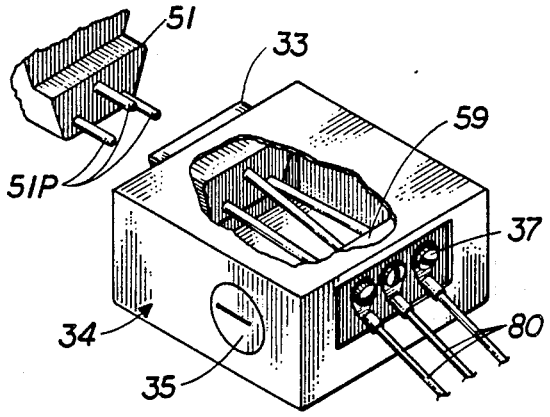
FIG. 7 is a close-up perspective view of a portion of the air terminal.

As has been noted, the system herein is intended for installation throughout one's household. Thus a typical floor plan of a residence with three baths is shown in FIG. 7. Blower 45 disposed within the garage, attic or basement and having a fresh air intake 46 projecting through the wall to deliver air through pipe system 54 to an individual pipeline 44 to bathroom number one. Other pipelines such as 43 within piping system 54 deliver air to other bathrooms. The pipelines are formed of 1.5 inch Schedule 20 PVC pipe and suitable connectors.

Figure 8:
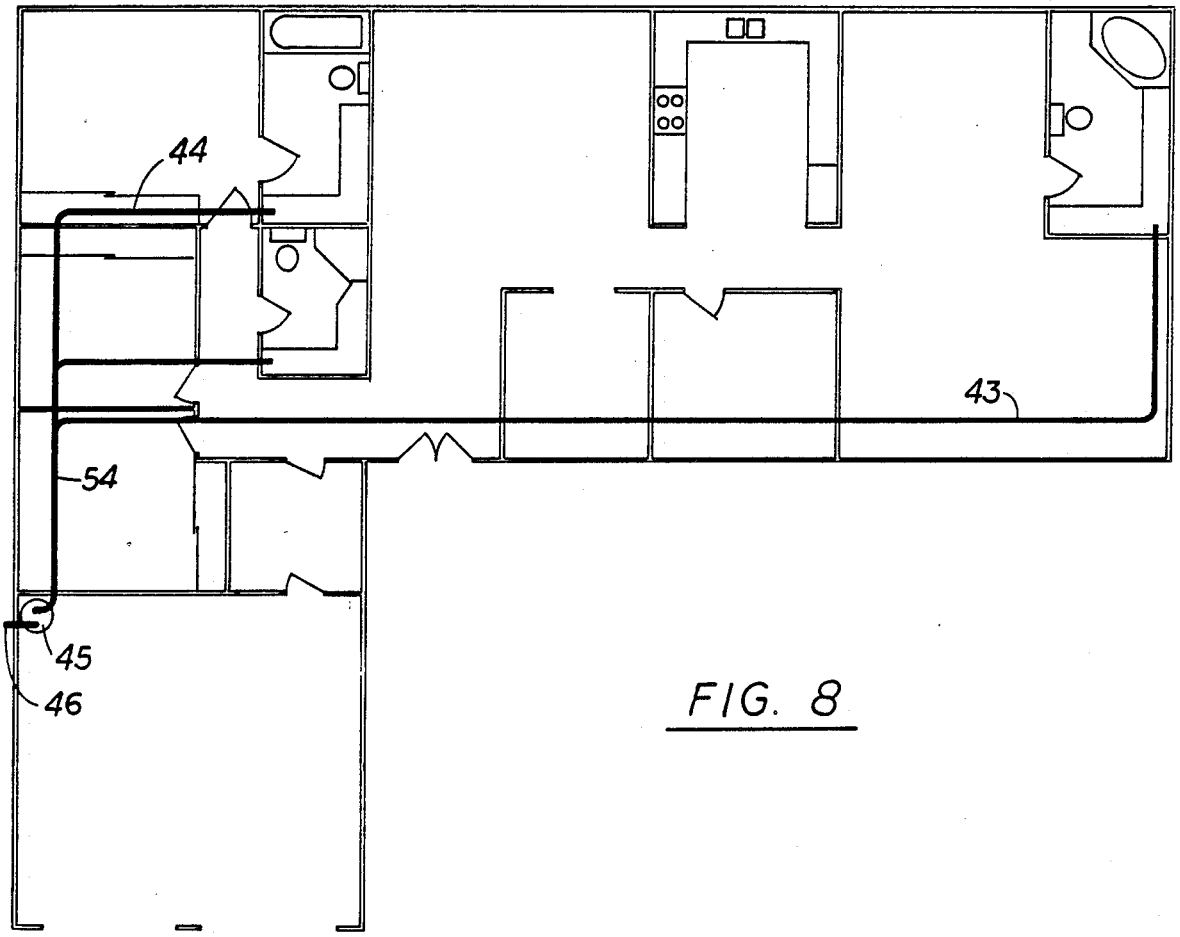
FIG. 8 is a floor plan view showing the disposition of the various elements of this invention within a household.

Pipe system 54 fluidly communicates with air terminal 32 via threaded or adhesed frictional engagement of an air line 44 thereof with the elbow 32'. Pipe system 54 is also connected to the blower 45 as is seen in FIG. 8.

Figure 9:
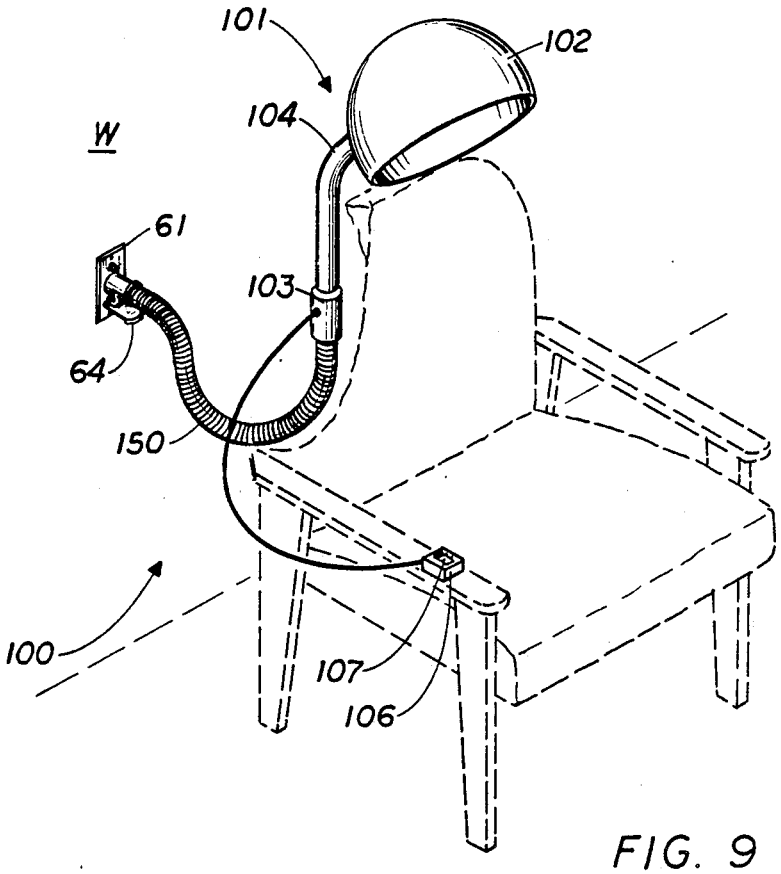
FIG. 9 is a perspective view of a second embodiment of this invention configured for use with a commercial hair-drying unit.

FIG. 9 depicts an adaptation of the current technology to the commercial environment. Here in embodiment 100, blow-dryer unit 101 includes a bonnet 102 and a switch controlled in-line heater 103 disposed within riser 104. Flex tubing 150 is suitably connected at the outlet cover 61 to the pipe system 54 (not seen). Note the position of outlet hatch cover 64. A typical salon chair where the apparatus would be used is shown in dashed line spaced from wall W on which is seen the cover plate 61. A movable control pad 106 with a heat control switch 107 is attached to allow control of the heater 103.

In order to utilize the system of this invention, one lowers the hatch cover 64 of outlet cover plate 61, inserts collar 48 with electrical connector 51 and the contact strip 47 each properly aligned for electrical contact into the rough-in outlet 68 and correspondingly into the air terminal 32. One then uses the switch 41 to flow the air stream over resistance heater 40 for the delivery of warm air, or such can transpire automatically upon collar connection for air flow, with the switch 41 serving merely for heat intensity control (High, Medium, Low).

Preferably a damper (not seen) is disposed within the dryer 11 such that upon movement of switch 41, the damper is opened and at the same time, the current is applied to the resistance heater.

Flow of air from the blower 45 is controlled by the low voltage connection 47 which leads to a solenoid, not seen, that controls the operation of the blower. Thus if collar 48 is removed, the low voltage connection is broken such that the air will not continue to flow. Thus it is seen that while it is preferable to have a second damper within the dryer unit 11 to limit air flow after the attachment of collar 48, such is not required.

It is seen that there has been disclosed a unique central hair and body drying system that is safe to use, easy to set up and easy to operate.

While the use of the low voltage blower actuation means is recommended, it is by no means necessary. It is also contemplated that a 110 volt blower actuation system can also be employed, though at higher cost.

While junction box 34 has been described as containing conventional GFI circuitry for safety sake, it is also contemplated not to include this extra higher cost circuitry. While the danger of electrical shock is higher, still the system would operate in like manner.

If an existing GFI were in place one could tap off load side of existing GFI to reduce cost. Also note that the National Electrical Code now requires GFI circuity in all new bathroom construction.

It is also contemplated by this invention to have the heating coil(s) for the dryer 11 to be disposed within collar 48, such that if one accidentally dropped dryer body assembly 39 into the sink or toilet, there would be no breakage of the GFI circuitry, nor any electrocution of the user.

The purpose of the damper within each air terminal is to achieve balanced air delivery to all terminals. Thus if one terminal's location is in a half-bath near the blower the air flow there would be stronger, i.e. more CFM than to a third floor. The damper in the half-bath's terminal would restrict flow to that terminal to ease the force, and would simultaneously send more air to the third story bath.

It is also to be seen that while the air terminal 32 has been discussed as a separate element, and that the rough-in outlet 68 has been discussed in like terms, it is within the scope of this invention for these two elements to be integrated into a unitary assembly for easy installation during the construction stage of a home. A preconstructed assembly of this nature would be made by preadhesing the air terminal 32 to the lip of the opening 72 of rough-in outlet 68. Or optionally the two elements can be formed as a single complex casting with the wiring added subsequent to the casting procedure.

Since certain changes may be made in the above product without departing from the scope of the invention involved, it is intended that all matter contained in the above description and shown in the accompanying drawings shall be interpreted as illustrative and not in a limiting sense.

I CLAIM

1. A central blow-drying system comprising:

a. a remotely actuatable air blower having a fresh air intake, for the delivery of air through b. a piping system in fluid communication with both of said blower and one or more c. air terminals, each of which comprises an elbow open at each end and having an aperture at a suitable location along the length thereof for receipt of a damper control shaft, a damper disposed in said elbow said damper being controlled by a shaft emanating therefrom and extending through said aperture, d. an electrical junction box electrically connected to a power source, and having an electrical female connector on the front surface thereof, e. ground fault interrupt circuitry disposed in said junction box and electrically interposed between said junction box female connector and the connection of the junction box to a power source, f. mount means for fixedly mounting said junction box and said air terminal for utilization;

g. a cover plate having a pivotable hatch cover overlying said air terminal and said female electrical connector secured to said junction box;

h. a hair dryer unit comprising a blow dryer and a flex tubing member in fluid communication with said blow dryer, said flex tubing member including electrical connector means for actuating said blower, and means for fluid communication with said air terminal, said blow dryer also including a switch controlled resistance heater therein.

2. A central blow-drying system comprising:

a. a remotely actuatable air blower having a fresh air intake, for the delivery of air through b. a piping system in fluid communication with both of said blower and one or more c. air terminals, each of which comprises an elbow open at each end and having an aperture at a suitable location along the length thereof for receipt of a damper control shaft, a damper disposed in said elbow said damper being controlled by a shaft emanatinq therefrom and extending through said aperture, d. an electrical junction box electrically connected to a power source, and having an electrical female connector on the front surface thereof, e. mount means for fixedly mounting said junction box and said air terminal for utilization;

f. a cover plate having a pivotable hatch cover overlying said air terminal and said female electrical connector secured to said junction box;

g. a hair dryer unit comprising a blow dryer and a flex tubing member in fluid communication with said blow dryer, said flex tubing member including electrical connector means for actuating said blower, and means for fluid communication with said air terminal, said blow dryer also including a switch controlled resistance heater therein.

3. A central blow-drying system comprising:

a. a remotely actuatable air blower having a fresh air intake, for the delivery of air through b. a piping system in fluid communication with both of said blower and one or more c. air terminals, each of which comprises an elbow open at each end and having an aperture at a suitable location along the length thereof for receipt of a damper control shaft, a damper disposed in said elbow said damper being controlled by a shaft emanating therefrom and extending through said aperture, d. an electrical junction box electrically connected to a power source, and having an electrical female connector on the front surface thereof, e. mount means for fixedly mounting said junction box and said air terminal for utilization;

f. a hair dryer unit comprising a blow dryer and a flex tubing member in fluid communication with said blow dryer, said flex tubing member including electrical connector means for actuating said blower, and means for fluid communication with said air terminal, said blow dryer also including a switch controlled resistance heater therein.

4. The central blow-drying system of claim 1 wherein said flex tubing member also includes means for electrically connecting the heater of said blow dryer to said junction box.

5. The central blow-drying system of claim 2 wherein said flex tubing member also includes means for electrically connecting the heater of said blow dryer to said junction.

6. The central blow-drying system of claim 1 wherein the means for actuating said blower included in said flex tubing member is a low voltage electrical connector that matingly engages a low voltage electrical connector disposed on said elbow of said air terminal.

7. The central blow-drying system of claim 2 wherein the means for actuating said blower included in said flex tubing member is a low voltage electrical connector that matingly engages a low voltage electrical connector disposed on said elbow of said air terminal.

8. The central blow-drying system of claim 3 wherein the mount means for fixedly mounting said junction box and said air terminal is a stud mountable rough-in outlet having a collar engageable with said air terminal.

9. The central blow-drying system of claim 8 wherein the rough-in outlet further includes an aperture aligned with said damper shaft for passage of said shaft through said outlet, and an opening for the reception of said electrical connector of said junction box.

10. The central blow-drying system of claim 1 wherein the mount means for fixedly mounting said junction box and said air terminal is a stud mountable rough-in outlet having a collar engageable with said air terminal.

11. The central blow-drying system of claim 10 wherein the rough-in outlet further includes an aperture aligned with said damper shaft for passage of said shaft through said outlet, and an opening for the reception of said electrical connector of said junction box.

12. The central blow-drying system of claim 1 wherein the flex tubing member also includes a male electrical connector wired to said heater switch and adapted for electrical engagement with the female connector of said junction box.

13. The central blow-drying system of claim 9 wherein the flex tubing member also includes a male electrical connector wired to said heater switch and adapted for electrical engagement with the female connector of said junction box.

14. The central blow-drying system of claim 11 wherein the flex tubing member also includes a male electrical connector wired to said heater switch and adapted for electrical engagement with the female connector of said junction box.

15. The central blow-drying system of claim 2 wherein the flex tubing member also includes a male electrical connector wired to said heater switch and adapted for electrical engagement with the female connector of said junction box.

16. The central blow-drying system of claim 2 wherein said hatch cover also overlies said female electrical connector secured to said junction box.

17. The central blow-drying system of claim 1 wherein said hatch cover also overlies said female electrical connector secured to said junction box.

18. The central blow-drying system of claim 2 wherein the mount means for fixedly mounting said junction box and said air terminal is a stud mountable rough-in outlet having a collar engageable with said air terminal, and the rough-in outlet further includes an aperture aligned with said damper shaft for passage of said shaft through said outlet, and an opening for the reception of said electrical connector of said junction box.

19. The central blow-drying system of claim 2 wherein the dryer includes a bonnet to fit the head of the user.

20. The central blow-drying system of claim 15 wherein the dryer includes a bonnet to fit the head of the user.

21. The central blow-drying system of claim 3, wherein the electrical junction box is electrically connected to a remote GFI circuit.

* * * * *